US010160565B2

(12) United States Patent
Lee et al.

(10) Patent No.: US 10,160,565 B2
(45) Date of Patent: Dec. 25, 2018

(54) FOOD BAG WORKING TOOL

(71) Applicant: San Jamar, Inc., Elkhorn, WI (US)

(72) Inventors: Jeffrey Lee, East Troy, WI (US); Michael Young, Mukwonago, WI (US)

(73) Assignee: San Jamar, Inc., Elkhorn, WI (US)

( * ) Notice: Subject to any disclaimer, the term of this patent is extended or adjusted under 35 U.S.C. 154(b) by 178 days.

(21) Appl. No.: 15/289,326

(22) Filed: Oct. 10, 2016

(65) Prior Publication Data

US 2018/0099772 A1 Apr. 12, 2018

(51) Int. Cl.

| | |
|---|---|
| ***B65B 69/00*** | (2006.01) |
| ***B25F 1/00*** | (2006.01) |
| ***B26B 11/00*** | (2006.01) |
| ***B67B 7/46*** | (2006.01) |

(52) U.S. Cl.

CPC ..... *B65B 69/0008* (2013.01); *B25F 1/00* (2013.01); *B26B 11/00* (2013.01); *B65B 69/005* (2013.01); *B65B 69/0033* (2013.01); *B67B 7/30* (2013.01)

(58) Field of Classification Search

CPC ..... B25F 1/00; B26B 11/00; B65B 69/0008; B65B 69/0033; B65B 69/005

See application file for complete search history.

(56) References Cited

U.S. PATENT DOCUMENTS

| | | | |
|---|---|---|---|
| 838,852 | A | 12/1906 | Eckley |
| 928,018 | A | 7/1909 | Barnard |
| 1,795,527 | A | 3/1931 | Tyreman |
| 3,142,074 | A | 7/1964 | Reich |
| D223,786 | S | 6/1972 | Phillips |
| D262,731 | S | 1/1982 | Austin |
| 4,514,902 | A | 5/1985 | Stewart |
| 4,570,339 | A | 2/1986 | Taylor |
| 4,599,758 | A | 7/1986 | Stiles |
| D289,133 | S | 4/1987 | Taylor |
| D292,071 | S | 9/1987 | Weir |
| 4,778,082 | A | 10/1988 | Vitelle |
| D305,499 | S | 1/1990 | Walker |
| 4,928,851 | A | 5/1990 | Eatherly |

(Continued)

FOREIGN PATENT DOCUMENTS

WO 1998030489 A1 7/1998

OTHER PUBLICATIONS

Extended European Search Report dated Mar. 14, 2018 (EP Application No. 17189698.8).

(Continued)

*Primary Examiner* — David B Thomas
(74) *Attorney, Agent, or Firm* — Boyle Fredrickson S.C.

(57) ABSTRACT

A kitchen utensil or tool that includes a cutter, a hook, and a squeegee and that is particularly usable for interaction with bulk single use bags. The utensil is defined by a generally elongate body such that the hook and the cutter are oriented at a common end thereof. The body defines a handle that is associated with the opposite longitudinal end portion of the body. The body includes a slot that extends in the longitudinal direction such that the squeegee is defined by portions of the body adjacent the slot. An open end of the slot is disposed proximate the handle such that, during emptying of an opened bag, the hand of the user associated with the handle can support a cantilevered portion of the body that defines one of the sides of the squeegee.

20 Claims, 7 Drawing Sheets

(56) References Cited

U.S. PATENT DOCUMENTS

| | | | | |
|---|---|---|---|---|
| 5,014,431 | A | 5/1991 | Jebe et al. | |
| D320,150 | S | 9/1991 | Huang | |
| D323,967 | S | 2/1992 | Talbot | |
| 5,101,562 | A | 4/1992 | Horvath et al. | |
| D334,702 | S | 4/1993 | Godsey | |
| D341,050 | S | 11/1993 | Waffensmith | |
| 5,282,316 | A | 2/1994 | Anderson | |
| D348,370 | S | 7/1994 | Yarnmunilert | |
| 5,347,617 | A | 9/1994 | Hunts | |
| 5,347,671 | A * | 9/1994 | Hunts | B65D 33/1675 24/30.5 R |
| D356,001 | S | 3/1995 | Yarnmunilert | |
| D360,326 | S | 7/1995 | Fairbanks | |
| D363,629 | S | 10/1995 | Bost | |
| 5,501,369 | A | 3/1996 | Tal | |
| D378,557 | S | 3/1997 | Tal | |
| D380,869 | S | 7/1997 | Bergman | |
| 5,752,319 | A | 5/1998 | Su et al. | |
| 5,809,608 | A * | 9/1998 | Zadro | B41F 15/44 15/245 |
| D401,492 | S | 11/1998 | Joseph, Jr. | |
| 5,867,693 | A | 1/1999 | Patronaggio | |
| 5,890,290 | A | 4/1999 | Davis | |
| D444,015 | S | 6/2001 | Tipp | |
| D444,016 | S | 6/2001 | Tipp | |
| 6,263,772 | B1 | 7/2001 | Navot et al. | |
| D460,908 | S | 7/2002 | Sun | |
| D479,957 | S | 9/2003 | Anthony | |
| 6,629,327 | B2 * | 10/2003 | Adams | B26B 27/00 24/30.5 R |
| 6,892,456 | B2 * | 5/2005 | Yu Chen | B26B 5/00 30/125 |
| D506,657 | S | 6/2005 | Hara | |
| D508,390 | S * | 8/2005 | Trbovich, Jr. | D8/98 |
| D514,916 | S | 2/2006 | Craig | |
| D521,844 | S | 5/2006 | Kempker et al. | |
| D527,604 | S | 9/2006 | Kempker et al. | |
| D544,739 | S | 6/2007 | Knowles | |
| D548,552 | S | 8/2007 | Elkaim | |
| D573,436 | S | 7/2008 | Wu | |
| D594,729 | S | 6/2009 | Cheldin | |
| D596,011 | S | 7/2009 | Almayda | |
| D639,631 | S | 6/2011 | Kempker et al. | |
| D649,001 | S | 11/2011 | Still | |
| D673,440 | S | 1/2013 | Kempker et al. | |
| D682,065 | S | 5/2013 | Gringer | |
| D684,451 | S | 6/2013 | Jennings et al. | |
| D689,351 | S | 9/2013 | Webb, Jr. | |
| D692,288 | S * | 10/2013 | Locklear | D8/105 |
| D731,272 | S | 6/2015 | Salvat | |
| 9,107,695 | B2 | 8/2015 | Horton | |
| D767,352 | S | 9/2016 | Tarbell | |
| D767,966 | S | 10/2016 | Standlee | |
| D784,107 | S | 4/2017 | Chen | |
| D801,148 | S | 10/2017 | Yu Chen | |
| D802,394 | S | 11/2017 | Yu Chen | |
| D805,347 | S | 12/2017 | Hundley | |
| D808,764 | S | 1/2018 | Weinberger | |
| 2002/0000045 | A1 | 1/2002 | Votolato | |
| 2002/0038612 | A1 | 4/2002 | Votolato | |
| 2002/0170570 | A1 | 11/2002 | Bergman | |
| 2003/0061665 | A1 | 4/2003 | Chen | |
| 2005/0000539 | A1 | 1/2005 | Bergman | |
| 2010/0101028 | A1 | 4/2010 | Cheldin | |
| 2013/0298409 | A1 | 11/2013 | Jacobs et al. | |
| 2014/0345146 | A1 | 11/2014 | Schekalla | |
| 2015/0150344 | A1 | 6/2015 | Lenhart | |
| 2015/0298330 | A1 | 10/2015 | Yu Chen | |
| 2017/0197320 | A1 | 7/2017 | Chen | |

OTHER PUBLICATIONS

Office Action dated Apr. 5, 2018 (U.S. Appl. No. 29/580,441).

Z-Rex Multi-Tool: announced Apr. 14th, 2015 [online]. Site Visited {Feb. 16th, 2018]. Available from Internet URL: https://www.leatherman.com/z-rex-32.html.

Car Back Seat Headrest Hanger: Site Visited [Feb. 16th, 2018]. Available from Internet URL: https://www.lazada.com.ph/universal-car-back-seat-headrest-hanger-holder-hooks-for-bag-purse-cloth-grocery-inti-72004745.html?spm=a2041.searchlistcategory.list.57.6e648e3bZZHGe3.

* cited by examiner

FOOD BAG WORKING TOOL

BACKGROUND OF THE INVENTION

The present invention relates generally to hand tools and, more particularly, to a hand tool or kitchen utensil useful in the handling and emptying of bags associated with consumable food stuff preparations such as soup or the like.

For various reasons, many commercial, retail, grocery, and foodservice providers appreciate the convenience, sanitation, and product shelf life that is afforded by receiving and handling materials in bulk volumes and that are packaged in single use bags. The bags are commonly robust so as to be puncture and tear resistant and can further be configured to withstand downstream processing or preparation, such as heating via boiling, depending on the nature of the goods contained in the discrete bags. Such bags commonly do not include an operable opening associated with extracting the goods and must commonly be cut open to extract the goods from the bag. The handling and processing of foodstuff commodities in such a manner presents various unique considerations associated with allowing personnel to prepare and manipulate the bags of commodity in a safe and sanitary manner.

For instance, during preparation for consumption of soup materials contained in single or more than single serving bags, the soup or other flowable foodstuffs is removed from the bag for subsequent processing or serving. Some operators prefer to extract cool or cold soup products from the bags prior to heating whereas others prefer to heat the bagged soup by placing the sealed bag in a heated water bath. When heated in a water bath, the bag must be removed from the water bath and the heated contents removed from the bag for serving or subsequent processing or preparation. This process leaves kitchen personnel required to interact with the heated bag and the heated contents thereof. Commonly, whether removed from a water bath or when handling a cold or cool bag, the bag is suspended over a serving container or the like and the bottom of the bag is cut thereby allowing the contents of the bag to flow into a receiving or serving container. If only a single layer of the bag is cut, the soup can flow from the bag in a somewhat erratic manner exposing kitchen staff to possible incidental interaction with the soup and/or resulting in a portion of the soup missing or spilling from the serving vessel. Accordingly, it is preferred that the opposing layers of the bag be cut concurrently to effectuate better control of the dispensing of the contents from the bag. It is further preferred that the discrete layers of the bag be cut while the hands of staff are maintained a sufficient distance from the cut opening to mitigate incidental contact between preparation staff and the flowable foodstuffs.

A still further concern relates to efficient extraction of the entire contents of the bag. Less flowable materials, such as chili or the like, have a tendency to leave a portion of the material adhered to the interior surfaces of the bag after a majority of the contents have flowed from the bag. Removing the remaining contents of the bag requires that the opposing sides of the bag be pressed toward one another and maintained in close or preferably contacting engagement with one another in a direction from the closed end of the bag toward the cut open end of the bag. Such a task is challenging when handling cool or cold bags but handling a heated bag makes it impractical to effectuate such an operation without the use of a tool or other kitchen utensils. Further, the generally suspended orientation of the bag renders counter or other flat kitchen surfaces unusable for the desired extraction of the final contents of the bag.

Still further concerns relate to sanitary and efficiency conditions associated with kitchen operations. The various interactions associated with placing and removing the bulk bags relative to a water bath, cutting an end of the bag, and squeezing the residual contents from a bag can limit direct physical interaction with the bag to effectuate the desired manipulations and interactions with the bag during the heating and/or emptying processes. The various interactions and manipulations can require use of various discrete utensils. Locating, using, cleaning, and storing various discrete utensils can detract from the efficiency with which staff personnel can achieve the desired interaction with bulk bag containers regardless of the contents of the discrete bags.

Therefore, there is a need for a kitchen utensil or bag working tool that can be used to extract, open, and extricate a majority of the contents of discrete bags. There is a further need for a bag working tool that is ergonomic and provides a desired separation between the hand of the user, the bag being manipulated, and the contents thereof.

SUMMARY OF THE INVENTION

The present invention provides a bag working or kitchen utensil or tool and method of forming a bag working or kitchen utensil or tool that overcomes one of more the drawbacks mentioned above. One aspect of the invention discloses a kitchen utensil or tool that includes a cutter, a hook, and a slot or squeegee slot that is constructed to squeeze and scrape contents from flexible containers in a squeegee-like manner as the tool is slid along the exterior surfaces of a flexible container—such as a bag. The utensil is particularly suited for interaction with boilable and/or single use bulk bags. The utensil is defined by a generally elongate body such that the hook and the cutter are oriented at a common end thereof. The body defines a handle that is associated with the opposite longitudinal end portion of the body. The body includes a slot that extends in the longitudinal direction such that the is defined by respective portions of the body adjacent the slot to act in a squeegee-like manner with flexible containers associated with the slot as the body is translated relative to the flexible container—such as a bag. An open end of the slot is disposed proximate the handle such that, during emptying of a bag, the hand of the user associated with the handle can support a cantilevered portion of the body that defines one of the sides of the slot thereby effectuating more efficient squeezing of the sides of the bags together during extraction of the contents from the bag.

Another aspect of the invention that is useable or combinable with one or more of the above aspects or features includes a bag working tool. The bag working tool includes a body that is defined by a lateral axis that extends between opposing edges of the body and a longitudinal axis that extends between a first end portion and a second end portion of the body. A cutter is associated with a first end portion of the body and a slot is formed in the body. The slot extends along a portion of the longitudinal axis and is defined by a closed end that is disposed proximate the first end portion of the body and an open end that is disposed proximate the second end portion of the body.

A further aspect that is useable or combinable with one or more of the above aspects or features discloses a kitchen utensil having an elongate body. At least one of a blade and a hook are associated with one end of the elongate body and a handle is defined by another end of the elongate body. A squeegee is defined by a first portion of the elongate body and a second portion of the elongate body that are separated from one another by a slot that extends along a portion of the elongate body. The slot has an open end that is proximate the handle such that a bag can be disposed in the slot and subsequent translation of the utensil relative to an opened bag biases the remaining contents of the bag toward the open end.

Another aspect of the invention that is useable or combinable with one or more of the above aspects or features discloses a method of forming a bag working tool. The method includes securing a blade to an elongate body such that a cutting edge of the blade is oriented to cut when the bag working tool is translated relative to a bag in a cutting direction that is generally aligned with a longitudinal axis of elongate body. A slot is formed in the elongate body such that opposing sides of the bag can be disposed in the slot when the elongate body is translated in the cutting direction. Lateral translation of the bag working tool relative to the bag when the opposing sides of the bag are disposed in the slot effectuates removal of any remaining contents of the bag via the opened end of the bag.

These and other aspects, features, and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
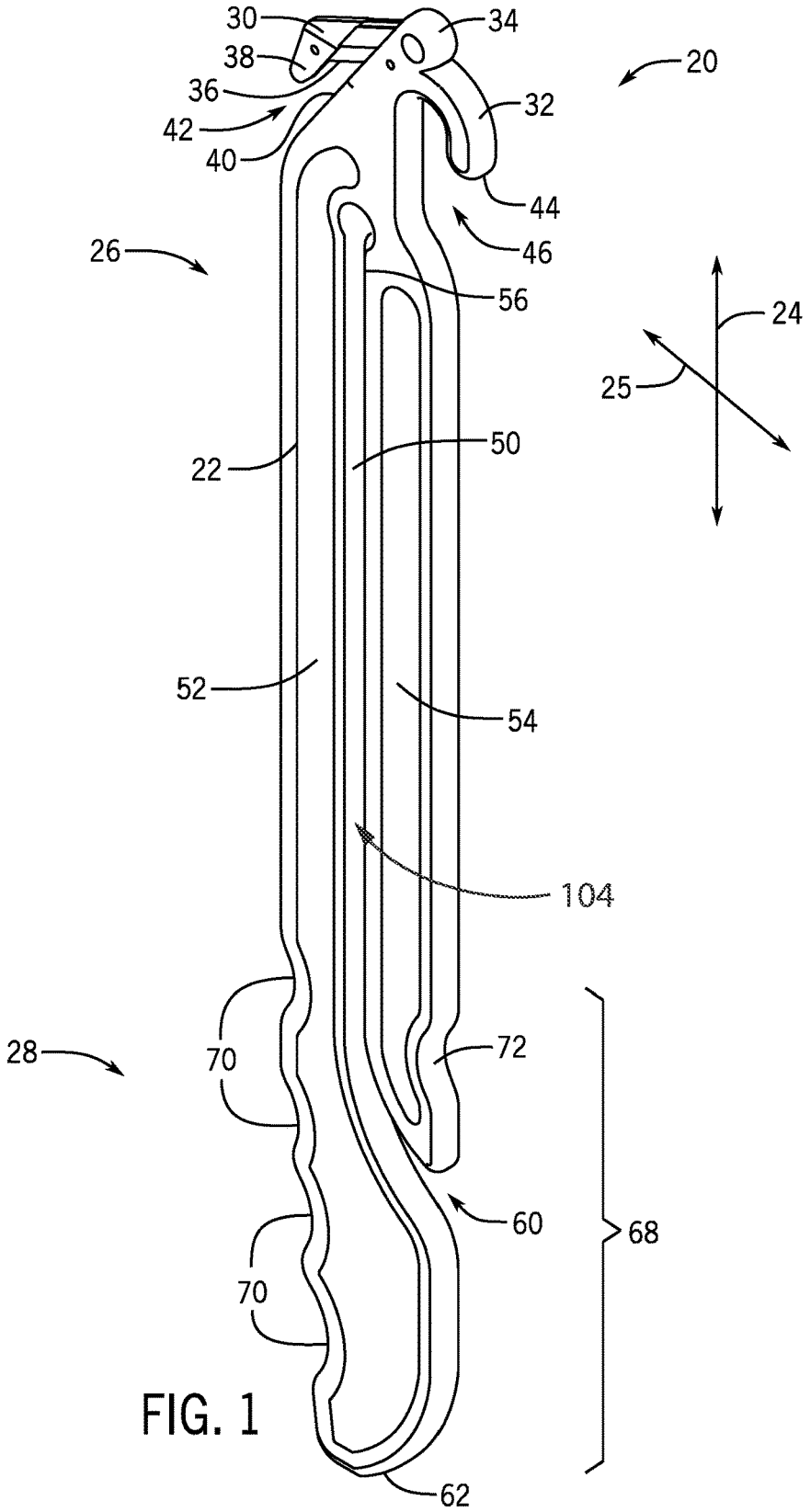
FIG. 1 is a side perspective view of a kitchen utensil or bag working tool according to the present invention.
Figure 2:
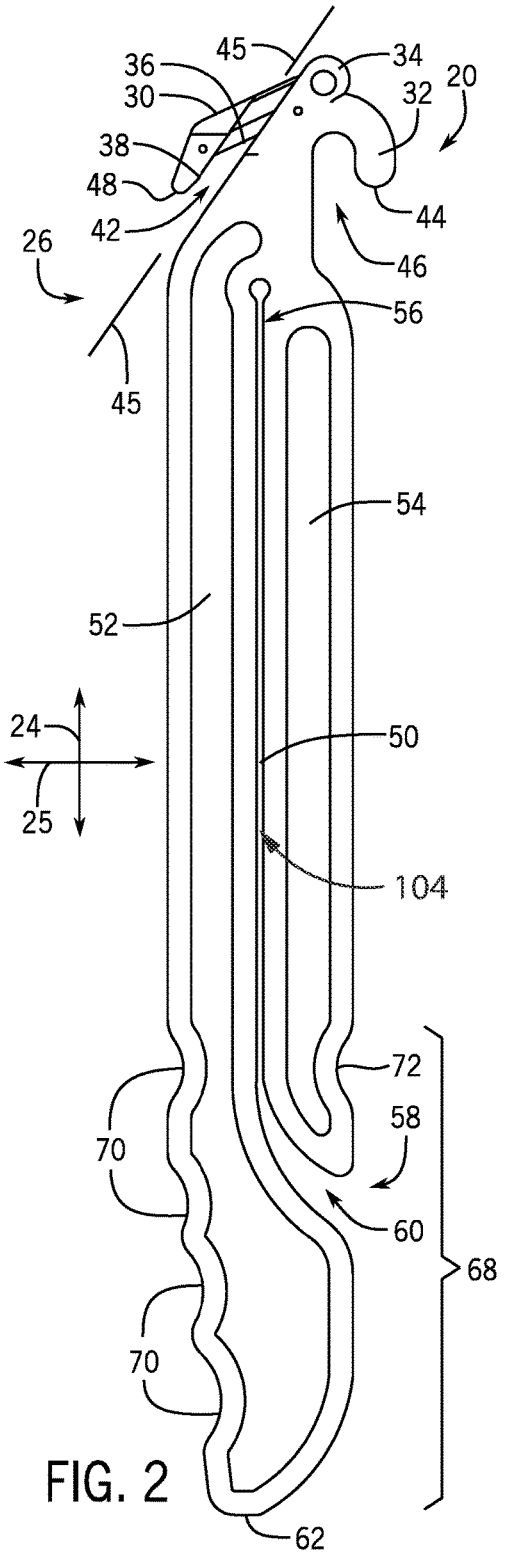
FIG. 2 is a right side elevation view of the bag working tool shown in FIG. 1.
Figure 3:
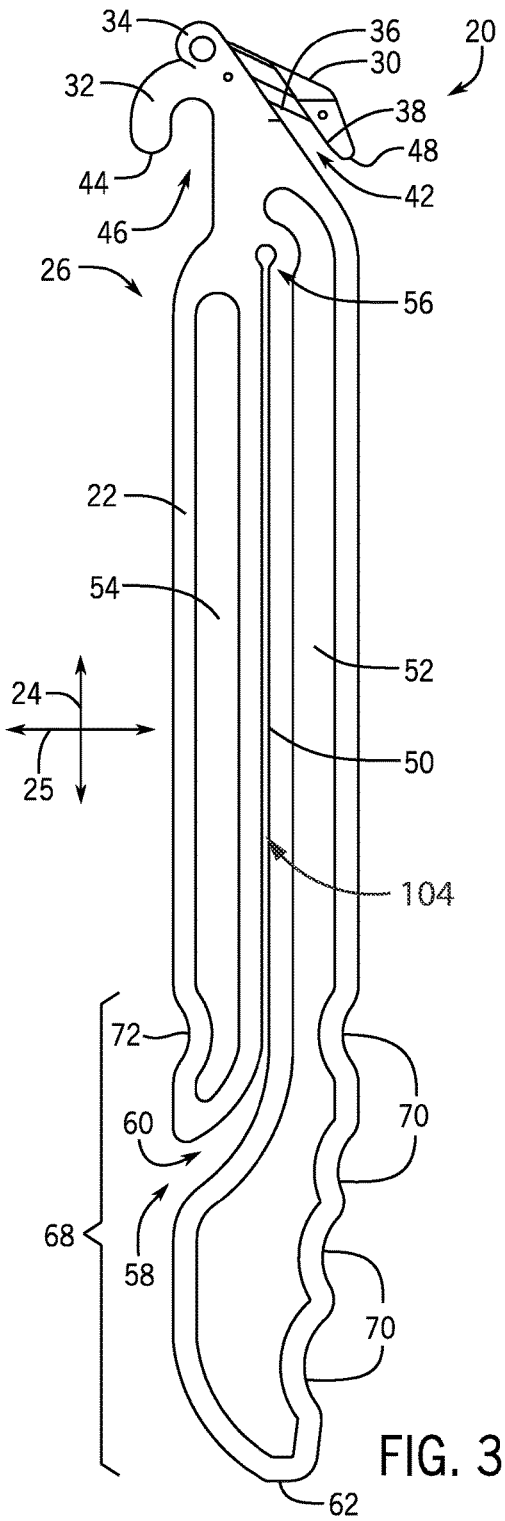
FIG. 3 is a left side elevation view of the bag working tool shown in FIG. 1.

FIG. 1 shows a kitchen utensil or bag working tool 20 according to the present invention. Bag working tool 20 is generally defined by a body 22. Referring to FIGS. 1-3, body 22 extends along a longitudinal axis or in a longitudinal direction, indicated by arrow 24, and a lateral axis or in lateral direction, indicated by arrow 25. Body 22 is generally planar and extends in the longitudinal direction between a first end portion 26 and a second end portion 28 associated with generally opposite longitudinal ends associated with axis 24 of body 22.

A blade 30 and an optional hook 32 are disposed proximate a distal end 34 associated with first end portion 26 of body 22 of bag working tool 20. Blade 30 and optional hook 32 are oriented to face in generally opposite lateral directions 27 relative to body 22. Said in another way, blade 30 and optional hook 32 each extend in respective crossing directions relative to body 22. Blade 30 is preferably formed of a metal material whereas optional hook 32 and body 22 are preferably formed of a plastic material although those skilled in the art will appreciate that blade 30 and body 22 could be formed of various other materials and/or combinations thereof. It is further appreciated that although hook 32 is shown as being integrally formed with the remainder of body 22, it is appreciated that hook 32 and/or blade 30 could be removably secured to body 22 or otherwise replaceable or otherwise more permanently secured to body 22 via overmolding or the like.

Still referring to FIGS. 1-3, blade 30 includes a cutting edge 36 that extends between a catch or guide portion 38 associated with a distal end portion of blade 30 and a perimeter edge portion 40 of body 22. A gap, channel, or groove 42 is formed between guide portion 38 of blade 30 and a blade facing portion associated with perimeter edge 40 of body 22. Distal end 44 of blade 30 is offset from distal end 34 associated with first end portion 26 of body 22 in a direction toward second end portion 28 of body 22 such that channel 42 preferably extends in a direction, indicated by line 45 (FIG. 2) that traverses or crosses both of longitudinal direction 24 as well as lateral direction 25 of body 22. As disclosed further below with respect to FIGS. 8-12, groove 42 is shaped to guide a material intended be cut toward cutting edge 36 of blade 30 and such that second end portion 28 of body 22 is oriented at a crossing direction and an offset orientation relative to the material and/or container or bag being worked.

Still referring to FIGS. 1-3, a gap, groove, contour, or channel 46 is associated with hook 32 and constructed to cooperate with materials being worked and/or to support the bag working tool 20 when not in use. Referring to FIGS. 2 and 3, blade 30 and hook 32 both extend in a generally cantilevered orientation relative to the remainder of body 22 such that the respective distal ends thereof 44, 48 extend toward second end portion 28 of body 22 relative to distal end 34 associated with first end portion 26 of body 22 and are at least partially offset from the remainder of body 22. Such a construction allows both blade 30 and hook 32 to be associated with a bag or a support structure, respectively, while the remainder of body 22 remains offset from the bag or the hanging structure in a generally canted or pitched orientation such that the bag, hanging structure, or adjacent structures remain offset from the hand and/or knuckles of the user.

A groove, gap, or slot 50 extends along at least a portion of longitudinal axis 24 between a first portion 52 and a second portion 54 defined by body 22. Slot 50 extends between a closed end 56 associated with first end portion 26 of body 22 and an open end 58 disposed nearer second end portion 28 of body 22. Open end 58 associated with slot 50 defines a mouth area or simply mouth 60 that is shaped to facilitate efficient slidable cooperation of bag working tool 20 with bag type materials as disclosed further below. First portion 52 of body 22 extends generally continuously between first end portion 26 and second end portion 28 of body 22 whereas second portion 54 of body 22 extends generally between first end portion 26 of body 22 and terminates short of a longitudinal distal end 62 associated with second end portion 28 of body 22 which is defined by first portion 52 of body 22. Said in another way, first portion 52 and second portion 54 each have a generally cantilevered construction as they each extend in a direction away from first end portion 26 of body 22 and such that first portion 54 has a longer longitudinal length relative to second portion 54.

Still referring to FIGS. 1-3, second end portion 28 of body 22 defines a handle portion or a handle 68 that is constructed to be gripped by a user. One or both of first portion 52 and second portion 54 of body 22 include one of more finger ridges 70, 72 that are configured to provide a positive tactile interaction between a hand of a user and bag working tool 20. As disclosed further below, during use, it is envisioned that a hand of a user can traverse slot or gap 50 proximate mouth 60 to mitigate deflection of first and second portions 52, 54 relative to one another during certain stages of bag opening and emptying operations performed with bag working device or tool 20.

Figure 4:
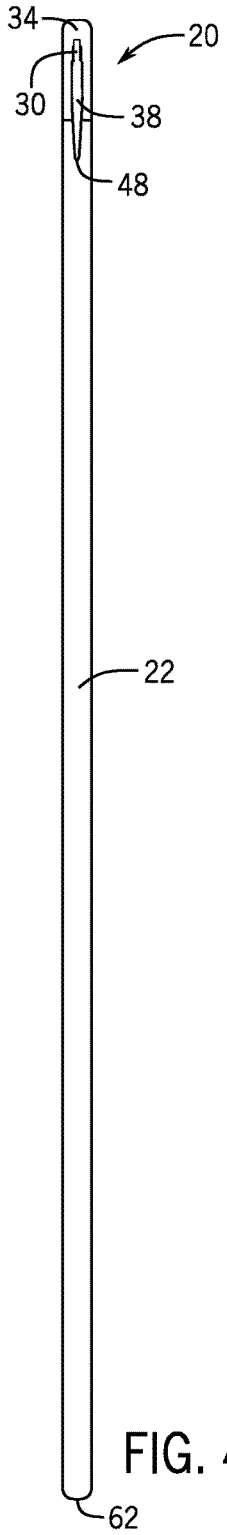
FIG. 4 is a front side elevation view of the bag working tool shown in FIG. 1.
Figure 5:
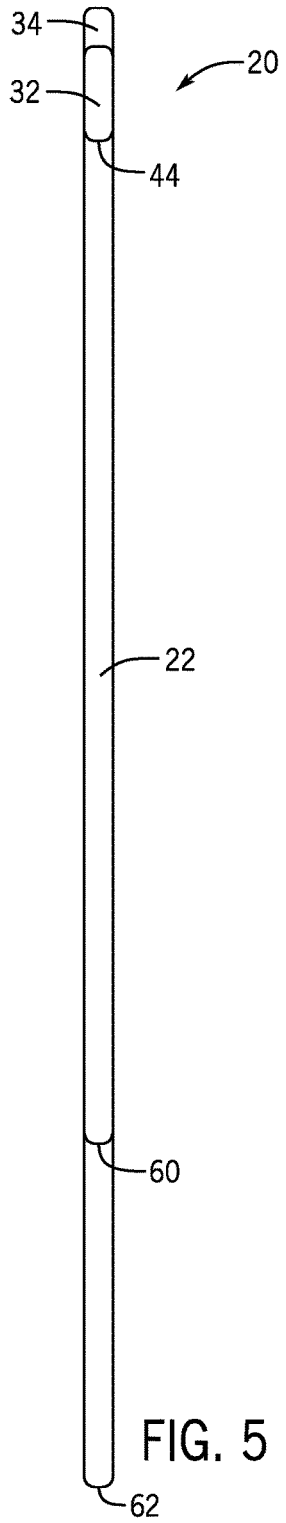
FIG. 5 is a rear side elevation view of the bag working tool shown in FIG. 1.
Figure 6:
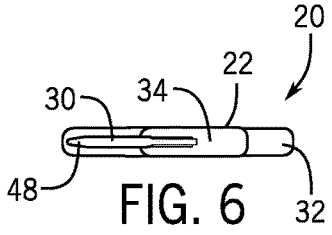
FIG. 6 is a top plan view of the bag working tool shown in FIG. 1.
Figure 7:
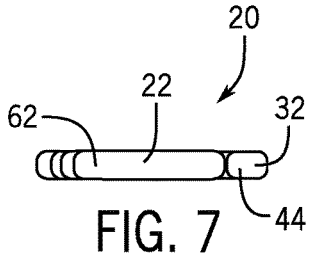
FIG. 7 is a bottom plan view of the bag working tool shown in FIG. 2.
Figure 8:
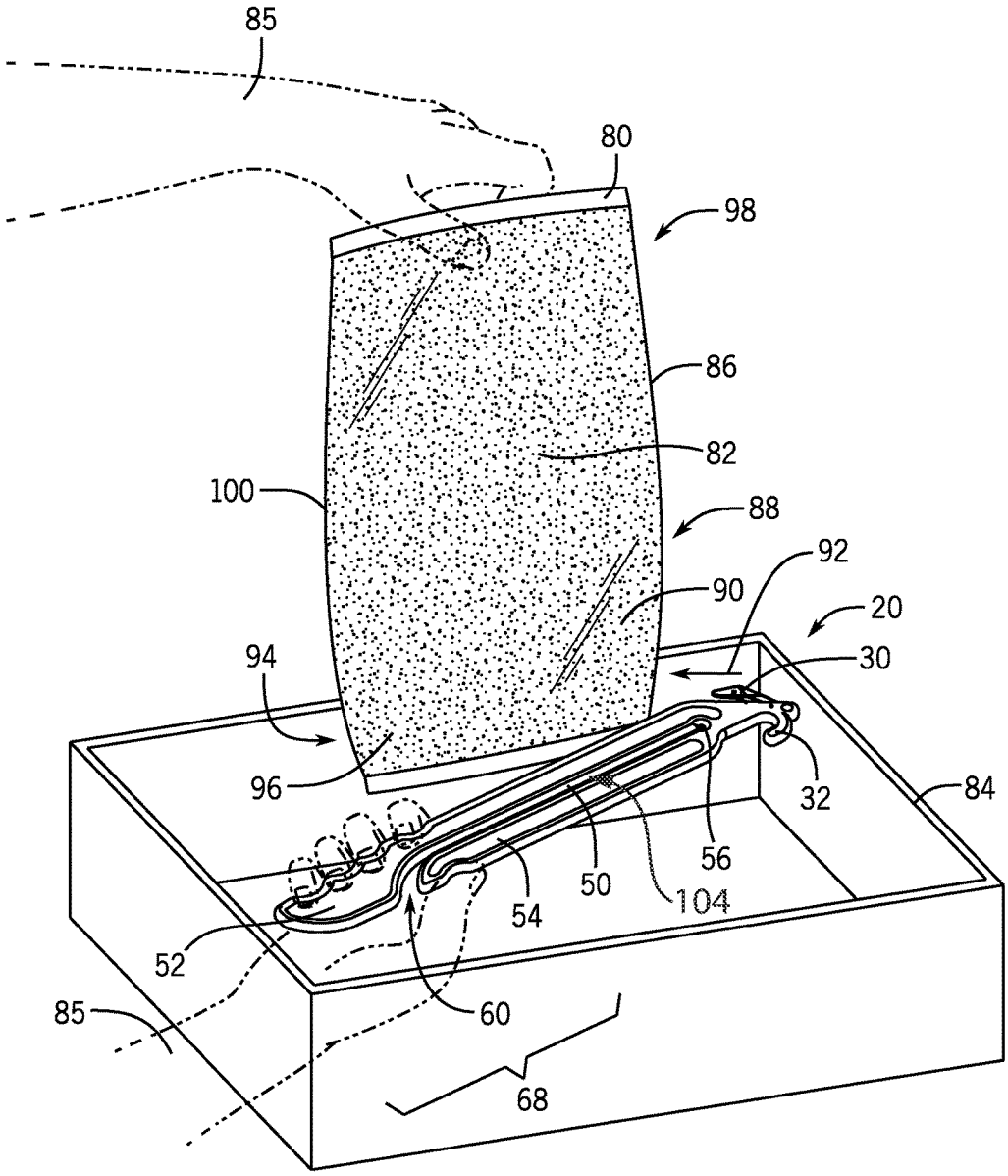
FIGS. 8-11 are various perspective views of the bag working tool during use of the bag working tool to open and assist emptying of the bagged materials.
Figure 9:
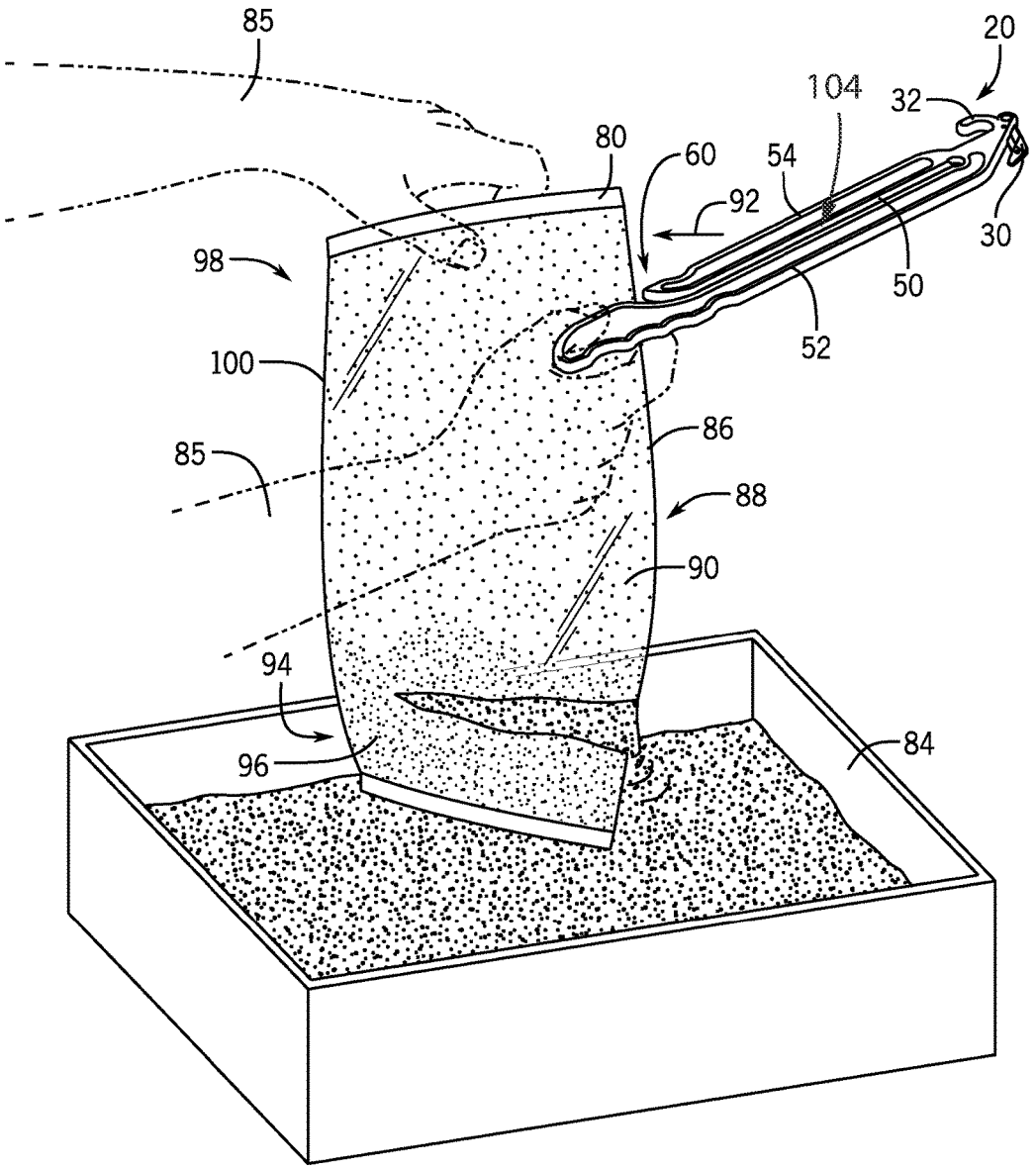
Figure 10:
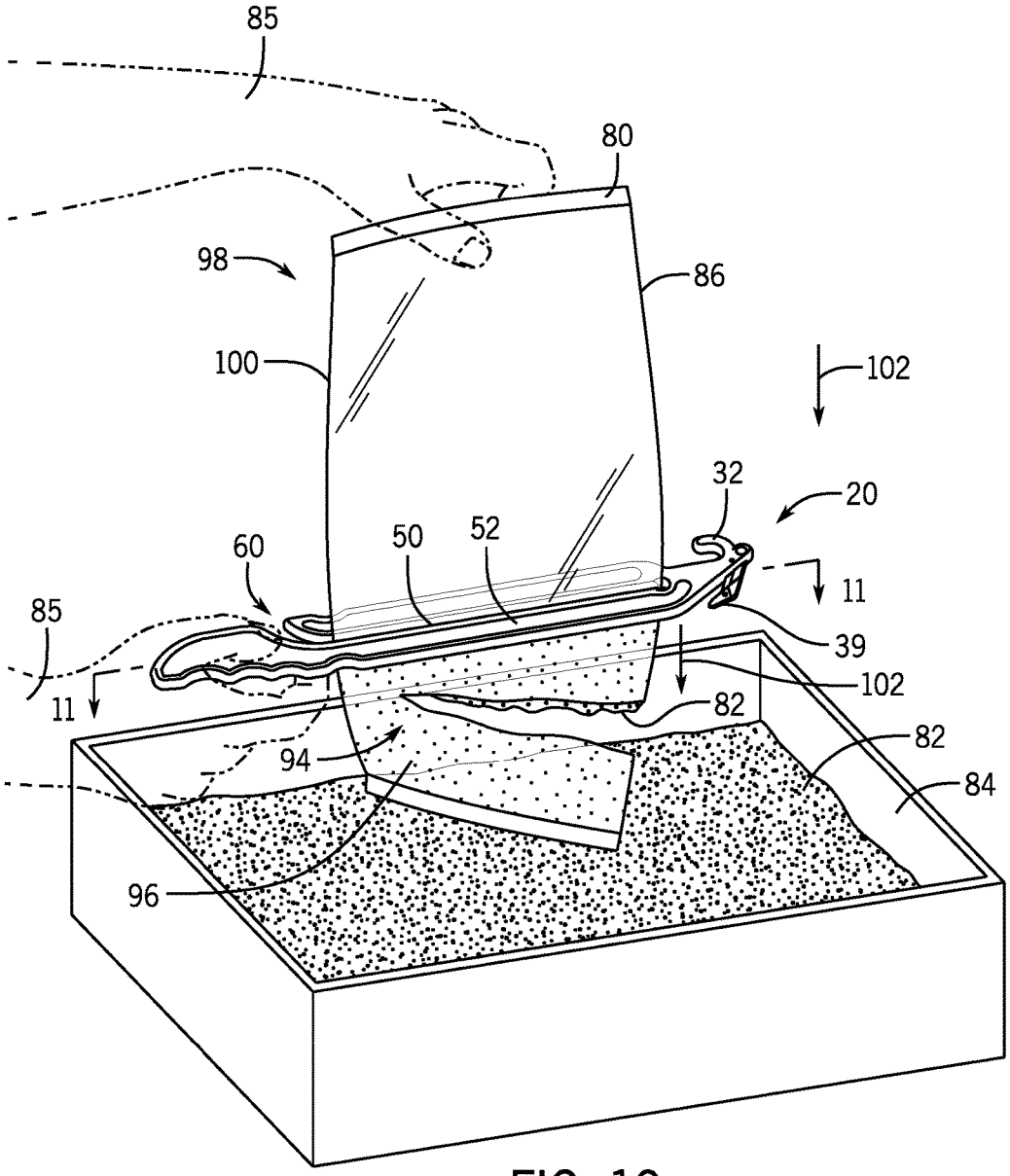
Figure 11:
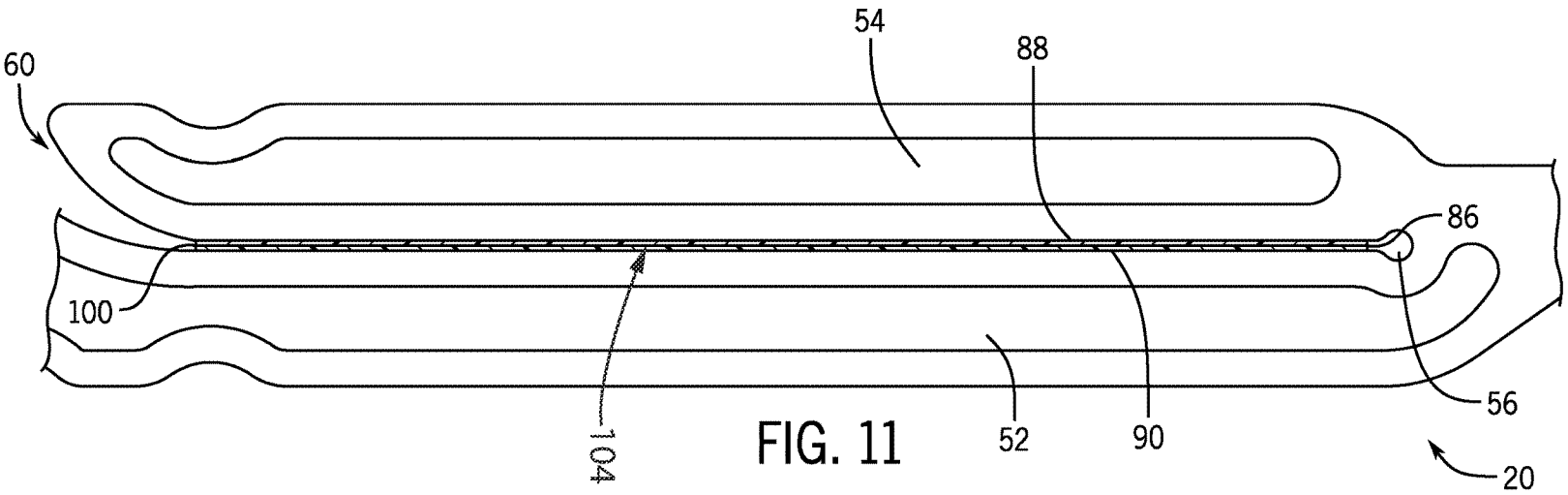

Referring to FIGS. 4-7, blade 30 is generally centrally disposed relative to a thickness, indicated by arrow 74, of body 22 of bag working tool 20. Referring to FIGS. 4 and 5, distal ends 34, 48 of hook 32 and blade 30 are only slightly offset from distal end 34 associated with first end portion 26 of bag working tool 20 relative to a total longitudinal length of bag working tool 20. Similarly, as indicated by FIG. 5, mouth 60 associated with gap 50 is disposed nearer to, but offset from, distal end 62 associated with second end portion 28 of bag working tool 20. Referring to FIG. 6, distal end 48 of blade 30 is disposed generally within a vertical footprint defined by body 22 of bag working tool 20. Such a consideration mitigates incidental or unintentional interaction of blade 30 with unintended structures and facilitates convenient and expedient placement and removal of the bag working tool in a sheath or the like. Comparatively, and referring to FIGS. 6 and 7, distal end 44 of hook 32 is provided in a configuration wherein the distal end 44 of hook 32 defines a portion of the vertical footprint of bag working tool 20. Such a consideration improves the ability of the user to quickly and efficiently associate the contour 46 associated with hook 32 with a support such as a portion of expanded metal shelving or the like.

Referring to FIGS. 8-11, bag working tool 20 is constructed to facilitate opening and drainage of a bag 80 that contains flowable foodstuffs, such as soup 82, or the like. It is appreciated that bag working tool 20 can be used for other kitchen operations that require opening of flexible disposable foodstuff containers, such as cereal bags of the like. When used to manipulate heated soup bags 80, hook 32 is useable to assist in the extraction of bag 80 from a water bath. Once extracted from a water bath, or when a cool or cold soup or otherwise flowable foodstuff materials is to be served, bag 80 is suspended over a receptacle 84. Blade 30 of bag working tool 20 is associated with an edge 86 of bag 80 that faces away from a user 85 such that distal end 48 of blade 30 is associated with a first side 88 of bag 80 and body 22 of bag working tool 20 is associated with an opposing or second side 90 of bag 80. Translation of bag working tool 20 in a lateral direction or a cutting direction, indicated by arrow 92, relative to bag 80 severs both sides 88, 90 of bag 80 proximate a lower or opened end 94 thereof such that gravity effectuates the drainage of soup 82 into receptacle 84. Preferably, during the cutting or opening operation, the cutting process is terminated prior to separation of a distal end 96 of bag 80 from the remainder of bag 80 thereby preventing the distal end 96 of bag 80 from commingling with the soup 82. If separated, the distal end 96 of bag 80 can be retrieved from soup 82 via blade 30 and/or hook 32.

Once the majority of soup 82 associated with bag 80 has drained therefrom, bag working tool 20 is associated with an upper or closed end 98 of bag 80 such that mouth 60 is associated with edge 86. Translation of bag working tool 20 in lateral direction 92 when mouth 60 is associated edge 86 proximate closed end 98 of bag 80 disposes opposing sides 88, 90 of bag 80 in slot 50 until closed end 56 of slot 50 impedes further translation of bag 80 in lateral direction 92. Preferably, the longitudinal length associated with slot 50 is sufficient to allow both of first portion 52 and second portion 54 of body 22 of bag working tool 20 to extend beyond an opposing edge 100 of bag 80. Such a consideration allows user 85 to interact with both of first and second portions 52, 54 of body 22 associated with handle 68 of bag working tool 20 when bag 80 is disposed in slot 50.

It is further appreciated that bag working tool 20 can be flipped about the longitudinal axis 24 such that it can be gripped by the dominant hand of the user and interact with bag 80 in the manner described above. It is further appreciated that bag working tool 20 can be flipped about lateral axis 25 such that the longitudinal axis 24 of body 22 extends generally along the forearm of user 85. When gripped in such a manner, it should be appreciated that the cut direction 92 would be oriented in a direction generally away from the body of the user 85. Similarly, mouth 60 would face in a direction generally away from the user 85 such that a generally outward directed arm stroke effectuates both the cutting or opening operation as well as association of bag 80 with groove 50 when blade 30 and mouth 60 are associated with edge 100 of bag 80. It is further appreciated that when oriented in such a manner, bag working tool 20 remains reversible about axis 24 such that bag working tool 20 is ambidextrously operable whether used in a "pushing" or "pulling" manner relative to the interaction with bag 20.

Regardless of the hand used or the grip orientation employed, when bag 80 is disposed in slot 50, translation of bag working tool 20 in a direction away from closed end 98 and toward opened end 94, indicated by arrow 102, presses sides 88, 90 of bag 80 into engagement with one another such that any residual foodstuffs or soup 82 associated with the interior surfaces of the discrete plys or layers associated with bag 80 are biased toward opened end 94 of bag 80 and subsequently delivered to the receptacle 84 disposed thereunder. The concurrent interaction of user 85 with the free ends associated with first portion and second portion 52, 54 of bag working tool 20 during this drainage or squeezing operation mitigates deflection of either of the first and second portions 52, 54 of bag working tool 20 relative to one another and effectuates a more thorough and efficient bag cleaning or drainage operation. Further, plurality of ridges 70, 72 provide a positive tactile indication with respect to interaction by user 85 with the free ends of one or both of the generally elongate members associated with first and second portions 52, 54 of body 22 of bag working tool 20. Once the contents of bag 80 have been delivered to receptacle 84, bag 80 can be disposed and bag working tool 20 can be cleaned and suspended from hook 32 to facilitate drying and suitable storage for subsequent use.

Therefore, one embodiment of the invention includes a kitchen utensil or tool 20 that includes a cutter or blade 30, a hook 32, and a squeezing/scraping structure or squeegee slot 104 that is constructed to act in squeegee-like manner as tool 20 is translated relative to a flexible container. The utensil 20 is particularly suited for interaction with boilable bags 80. The utensil 20 is defined by a generally elongate body 22 such that the hook 32 and the cutter 30 are oriented at a common end 26 thereof. The body 22 defines a handle 68 that is associated with the opposite longitudinal end 28 portion of the body 22. The body 22 includes a slot 50 that extends in the longitudinal direction such that the slot 50 is defined by portions of the body 22 adjacent the slot 50. An open end 58 of the slot 50 is disposed proximate the handle 68 such that, during emptying of a bag 80, the hand of the user associated with the handle 68 can support a cantilevered portion of the body 22 that defines one of the sides of the squeezing/scraping structure 104.

Another embodiment that is useable or combinable with one or more of the above features or embodiments includes a bag working tool. The bag working tool includes a body that is defined by a lateral axis that extends between opposing edges of the body and a longitudinal axis that extends between a first end portion and a second end portion of the body. A cutter is associated with a first end portion of the body and a slot is formed in the body. The slot extends along a portion of the longitudinal axis and is defined by a closed end that is disposed proximate the first end portion of the body and an open end that is disposed proximate the second end portion of the body.

A further embodiment that is useable or combinable with one or more of the above features or embodiments includes a kitchen utensil having an elongate body. At least one of a blade and a hook are associated with one end of the elongate body and a handle is defined by another end of the elongate body. A squeegee is defined by a first portion of the elongate body and a second portion of the elongate body that are separated from one another by a slot that extends along a portion of the elongate body. The slot has an open end that is proximate the handle such that a bag can be disposed in the slot and subsequent translation of the utensil relative to an opened bag biases the remaining contents of the bag toward the open end.

Another embodiment that is useable or combinable with one or more of the above features or embodiments includes a method of forming a bag working tool. The method includes securing a blade to an elongate body such that a cutting edge of the blade is oriented to cut when the bag working tool is translated relative to a bag in a cutting direction that is generally aligned with a longitudinal axis of elongate body. A slot is formed in the elongate body such that opposing sides of the bag can be disposed in the slot when the elongate body is translated in the cutting direction.

The present invention has been described in terms of the preferred embodiment, the embodiment disclosed herein is directed to the assembly as generally shown in the drawings. It is recognized that equivalents, alternatives, and modifications, aside from those expressly stated, to the embodiments summarized, or the embodiment shown in the drawings, are possible and within the scope of the appending claims. The appending claims cover all such alternatives and equivalents.

What is claimed is:

1. A bag working tool comprising:

a body defined by a lateral axis that extends between opposing edges of the body and a longitudinal axis that extends between a first end portion and a second end portion of the body;

a cutter associated with a first end portion of the body; and a slot formed in the body and extending along a portion of the longitudinal axis, the slot defined by a closed end that is disposed proximate the first end portion of the body and an open end that is disposed proximate the second end portion of the body.

2. The bag working tool of claim 1 wherein the open end of the slot is associated with one of the opposing edges of the body and is offset from a terminal end associated with the second end portion of the body.

3. The bag working tool of claim 2 further comprising at least one groove defined by the other opposing edge of the body and associated with the second end portion of the body.

4. The bag working tool of claim 1 wherein the slot extends a majority of the longitudinal axis of the body.

5. The bag working tool of claim 1 further comprising a hook associated with the first end portion of the body.

6. The bag working tool of claim 5 wherein the hook and the cutter face in opposite lateral directions associated with the opposing edges of the body.

7. The bag working tool of claim 1 further comprising a groove formed in a side face of at least one of a first portion of the body and a second portion of the body, wherein the first portion and the second portion of the body generally flank the slot.

8. A kitchen utensil comprising:

an elongate body;

at least one of a blade and a hook associated with one end of the elongate body;

a handle defined by another end of the elongate body; and a squeegee slot defined by a first portion of the elongate body and a second portion of the elongate body that are separated from one another and that extend along a portion of the elongate body such that the squeegee slot is offset in a longitudinal direction along the elongate body from the at least one of a blade and a hook, the squeegee slot having an open end that is proximate the handle.

9. The kitchen utensil of claim 8 further comprising both of the blade and the hook associated with the one end of the elongate body.

10. The kitchen utensil of claim 9 wherein the blade and the hook extend in opposite lateral directions oriented in a crossing direction relative to a longitudinal axis defined by the squeegee slot.

11. The kitchen utensil of claim 8 further comprising a mouth associated with the open end of the squeegee slot wherein opposing sides of the first portion and the second portion of the elongate body are further apart from one another at the mouth of the squeegee slot than along a majority of the squeegee slot.

12. The kitchen utensil of claim 8 wherein the handle further comprises at least one finger groove defined by an edge of the elongate body.

13. The kitchen utensil of claim 12 further comprising a plurality of finger grooves formed along the edge of the elongate body.

14. The kitchen utensil of claim 12 wherein the open end of the squeegee slot is associated with the handle such that the open end of the squeegee slot can be overlapped by a hand wrapped around the handle.

15. A method of forming a bag working tool comprising:

securing a blade to an elongate body such that a cutting edge of the blade is oriented to cut when the bag working tool is translated relative to a bag in a cutting direction that is generally aligned with a longitudinal axis of elongate body; and forming a slot in the elongate body such that opposing sides of the bag can be disposed in the slot when the elongate body is translated in the cutting direction.

16. The method of claim 15 further comprising forming a hook proximate the blade such that the hook and the blade extend in opposite lateral directions from a common end of the elongate body.

17. The method of claim 16 further comprising pitching the blade and the hook in a direction relative to the longitudinal axis such that a free distal end of each of the blade and the hook are nearer a handle defined by the elongate body than a support end associated with the hook and the blade, respectively.

18. The method of claim 15 further comprising forming a mouth of the slot proximate a handle defined by the elongate body.

19. The method of claim 18 further comprising forming a plurality of finger ridges with the elongate body proximate the handle such that the plurality of finger ridges are oriented opposite the mouth of the slot.

20. The method of claim 15 further comprising forming a grip contour in the sides of the elongate body adjacent the slot.

* * * * *